US007866233B2

(12) United States Patent
Swanson

(10) Patent No.: US 7,866,233 B2
(45) Date of Patent: Jan. 11, 2011

(54) MAGNETIC FASTENER HOLDER

(75) Inventor: Daniel C. Swanson, Lombard, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 0 days.

(21) Appl. No.: 12/048,485

(22) Filed: Mar. 14, 2008

(65) Prior Publication Data

US 2009/0229419 A1 Sep. 17, 2009

(51) Int. Cl.
*B25B 11/00* (2006.01)

(52) U.S. Cl. ..... 81/44; 81/13

(58) Field of Classification Search ..... 81/44, 81/462, 484, 486, 488, 13; 211/70.6; 408/76
See application file for complete search history.

(56) References Cited

U.S. PATENT DOCUMENTS

| | | | | | |
|---|---|---|---|---|---|
| 2,632,486 | A * | 3/1953 | Fetsko | 81/462 |
| 2,679,270 | A * | 5/1954 | Krause | 81/462 |
| 2,721,589 | A * | 10/1955 | Hammer | 81/462 |
| 2,818,894 | A * | 1/1958 | Miller | 81/462 |
| 3,693,862 | A * | 9/1972 | Giebel et al. | 227/11 |
| 4,037,632 | A * | 7/1977 | Arena | 81/44 |
| 4,610,580 | A * | 9/1986 | Palm | 408/136 |
| 5,174,690 | A * | 12/1992 | Targett et al. | 408/1 R |
| 5,320,003 | A * | 6/1994 | Ely et al. | 81/57.4 |
| 5,462,392 | A * | 10/1995 | Hardwick | 408/76 |
| 5,984,594 | A * | 11/1999 | Osborne et al. | 408/1 R |
| 6,047,934 | A * | 4/2000 | Roy et al. | 248/231.71 |
| 6,199,271 | B1 * | 3/2001 | Hahn et al. | 29/715 |
| 6,413,022 | B1 * | 7/2002 | Sarh | 408/76 |
| 7,387,475 | B2 * | 6/2008 | Beggs et al. | 408/76 |
| 2004/0093997 | A1 * | 5/2004 | Huang | 81/125 |
| 2005/0155211 | A1 | 7/2005 | Powell | |
| 2008/0056833 | A1 * | 3/2008 | Lay et al. | 408/76 |

* cited by examiner

*Primary Examiner*—David B Thomas
(74) *Attorney, Agent, or Firm*—Greenberg Traurig, LLP

(57) ABSTRACT

Described herein is technology for, among other things, a tool for assisting the attachment or removal of a first fastener and a second fastener to or from a structure. The tool includes a lower portion adapted to magnetically attach to a surface of the structure. The tool also includes an upper portion configured to be spaced a distance from the surface of the structure when the lower portion is magnetically attached to the surface of the structure. The upper portion also includes a holder extending therefrom and adapted to hold the first fastener. The holder is biased to urge the first fastener in a direction of the surface of the structure.

20 Claims, 4 Drawing Sheets

MAGNETIC FASTENER HOLDER

BACKGROUND

Attaching complementary fasteners, such as a nut and a bolt, to a structure is ordinarily a simple, one-person job. Situations may arise, however, when the structure is of such size and/or shape that a single person is not able to simultaneously access both fasteners. For example, attaching a nut and a bolt through a hole in the trunk floor of an automobile requires two people to accomplish—one to hold the screw in place while the other tightens the nut from underneath the automobile. Thus, in cases such as this, the otherwise simple, one-person task of fastening a nut and a bolt to structure becomes a two-person job. Moreover, this is undesirable from the standpoint of workman productivity and efficiency.

United States Publication No. 2005/0155211 by Powell discloses a magnetic bolt holder which has a hexagonal recess for securing a nut or a bolt to a ferrous structure. The Powell device is an insufficient solution to the above-stated problem for a number of reasons. First, the device is designed for a specific size and shape of fastener (e.g., a ¼" hex nut). Thus, a consumer would be required to purchase a different size/shape of the Powell device for each size fastener being used. Moreover, the magnetic surface of the device is substantially coplanar. The effectiveness of the device is therefore severely diminished, if not eliminated, when used on any non-flat surface.

Thus, conventional tools do not provide for a customizable solution to the above problem. Conventional tools also do not provide a solution that is adaptable for use with uneven surfaces.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Described herein is technology for, among other things, a tool for assisting the attachment or removal of a first fastener and a second fastener to or from a structure. The tool includes a lower portion adapted to magnetically attach to a surface of the structure. The tool also includes an upper portion configured to be spaced a distance from the surface of the structure when the lower portion is magnetically attached to the surface of the structure. The upper portion also includes a holder extending therefrom and adapted to hold the first fastener. The holder is biased to urge the first fastener in a direction of the surface of the structure.

Also described herein is technology for, among other things, a tool for assisting the attachment or removal of a first fastener and a second fastener to or from a structure. The tool includes a main body having a holder extending therefrom. The tool also includes adjustable feet adjustably coupled to the main body and adapted to magnetically attach to a surface of the structure. The holder is biased to urge the first fastener in a direction of the surface of the structure.

Also described herein is technology for, among other things, a tool system for assisting the attachment or removal of a first fastener and a second fastener to or from a structure. The tool system includes a drive bit adapted to mate with the first fastener and a magnetic fastener holder. The magnetic fastener holder includes a lower portion adapted to magnetically attach to a surface of the structure. The magnetic fastener holder also includes an upper portion configured to be spaced a distance from the surface of the structure when the lower portion is magnetically attached to the surface of the structure. The upper portion of the magnetic fastener holder includes a drive bit holder extending therefrom, which is adapted to received the drive bit. The drive bit holder is also biased to urge the drive bit and the first fastener in a direction of the surface of the structure.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail so as not to unnecessarily obscure aspects of the present invention.

Generally speaking, embodiments provide for a magnetic fastener holder that is adapted to securely hold a first fastener in place, relative to a surface of structure, so that a second fastener may be attached to the first fastener from a second surface of the structure. For example, a user may place a screw into a correspondingly sized hole in the structure. The user may then position the magnetic fastener holder over the screw to hold the screw place. The magnetic fastener holder will continue to hold the screw in place without human assistance. Thus, the user may then attach a nut, bracket, or other fastener to the other side of the screw without having to hold the screw in place himself and without the assistance of a second person.

The magnetic fastener holder may be adaptable to hold virtually any size, shape, or type of fastener in place. In one embodiment, this is achieved using an interchangeable drive bit system. In one embodiment, the magnetic fastener holder is adjustable to enable it to be attached to uneven surfaces in addition to typical flat surfaces.

Figure 1A:
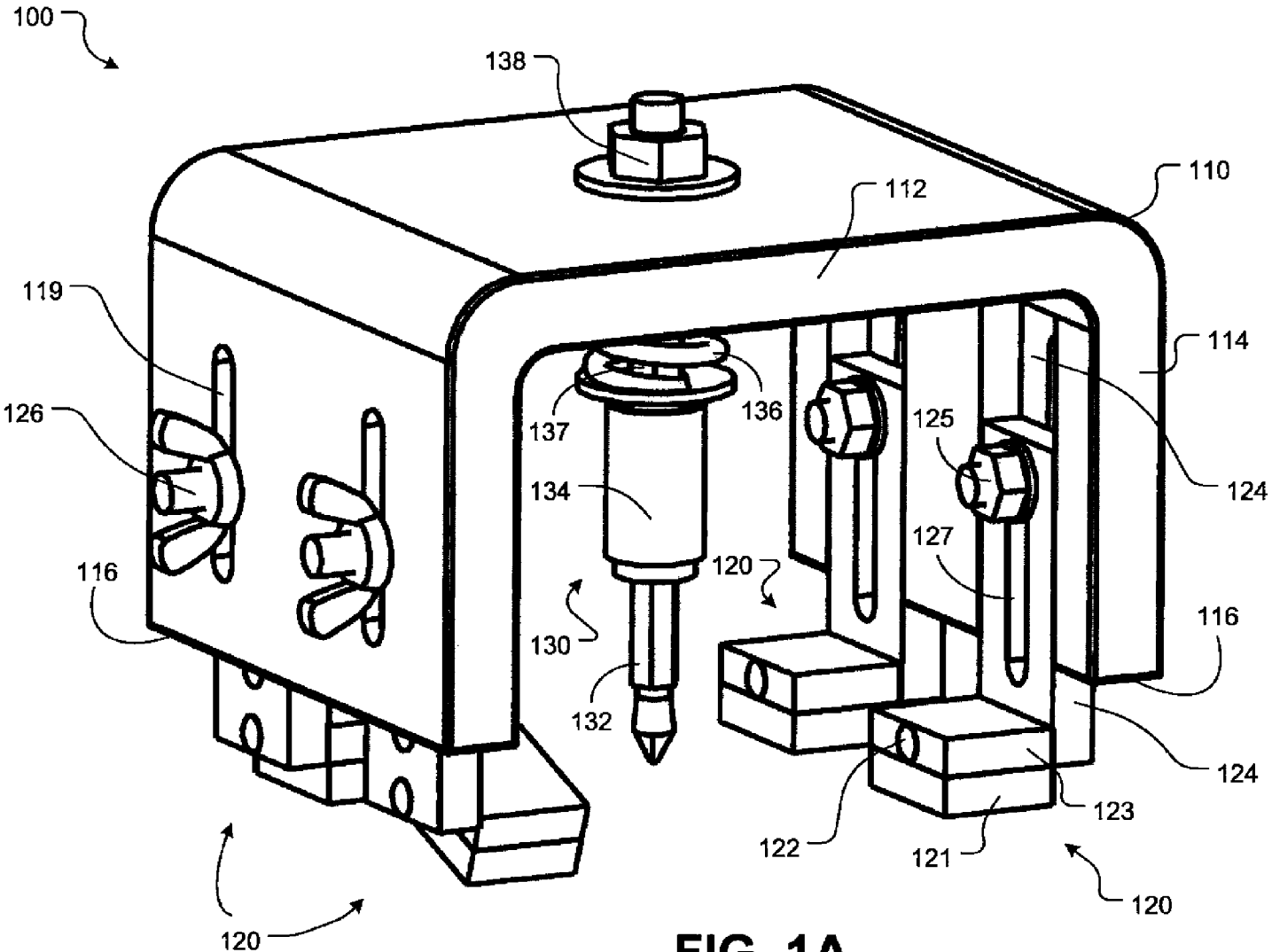
FIG. 1A is a top-perspective view of a magnetic fastener holder, in accordance with an embodiment of the present invention.
Figure 1B:
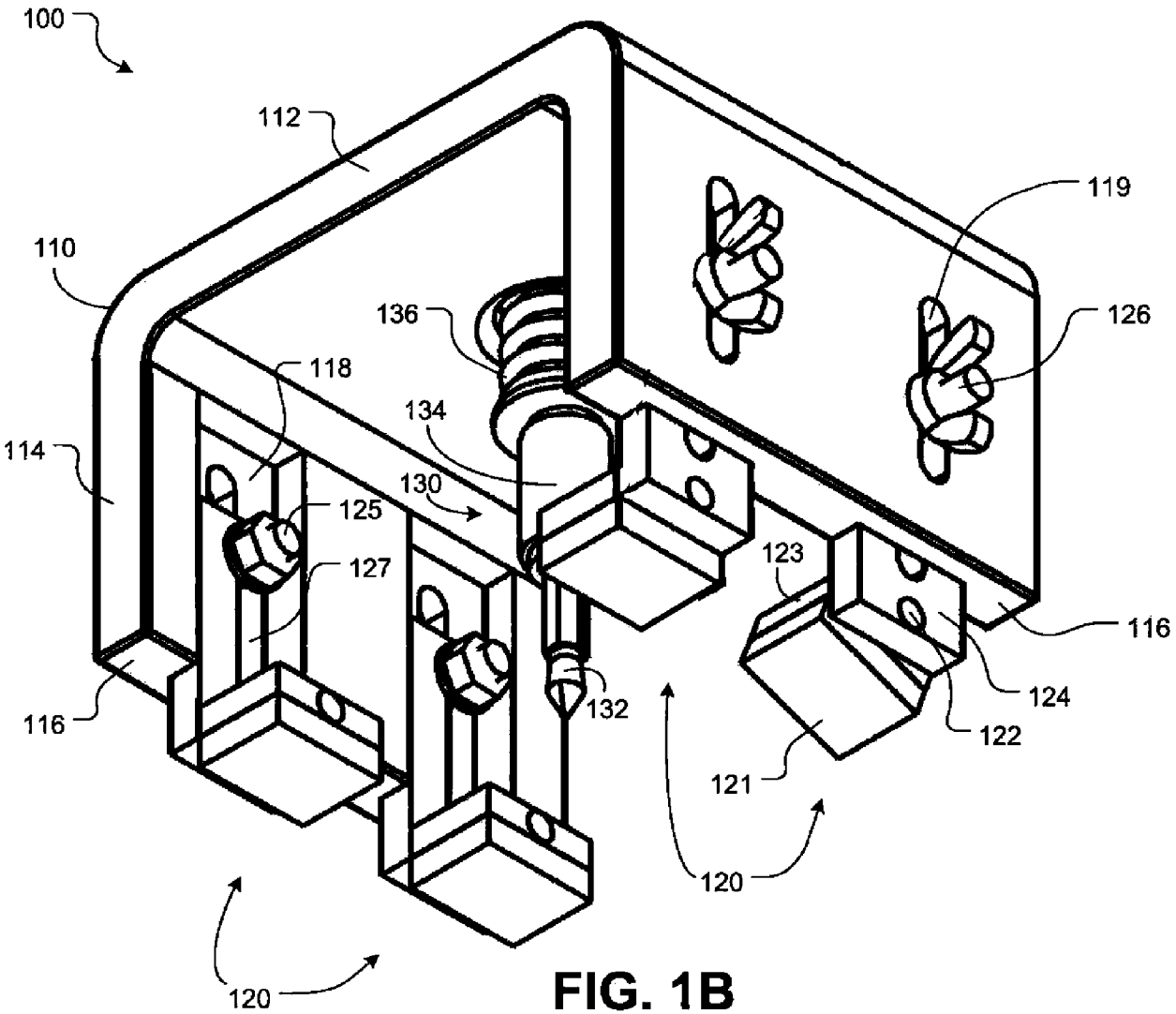
FIG. 1B is a bottom-perspective view of the magnetic fastener holder of FIG. 1A.
Figure 1C:
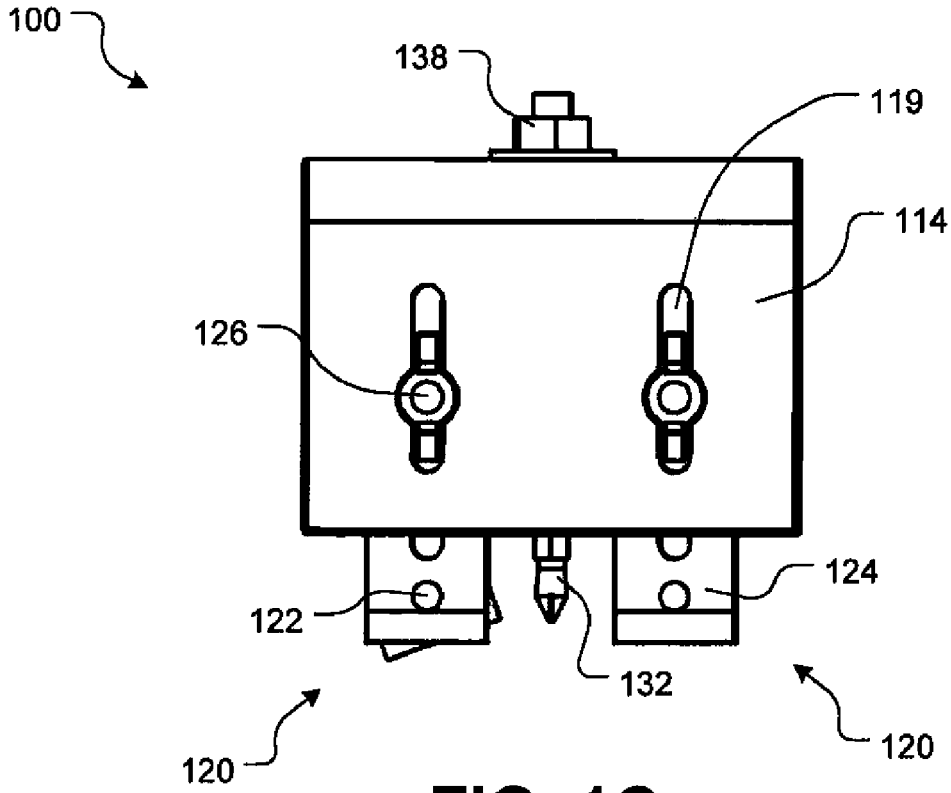
FIG. 1C is a side view of the magnetic fastener holder of FIG. 1A.
Figure 1D:
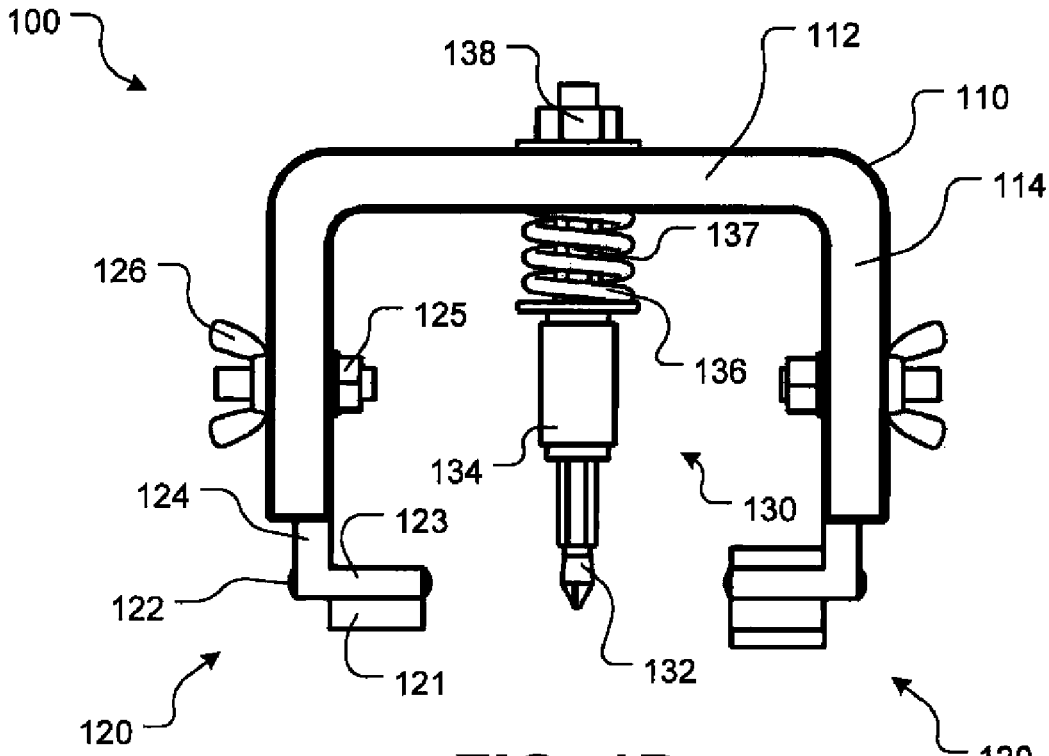
FIG. 1D is a front view of the magnetic fastener holder of FIG. 1A.
Figure 1E:
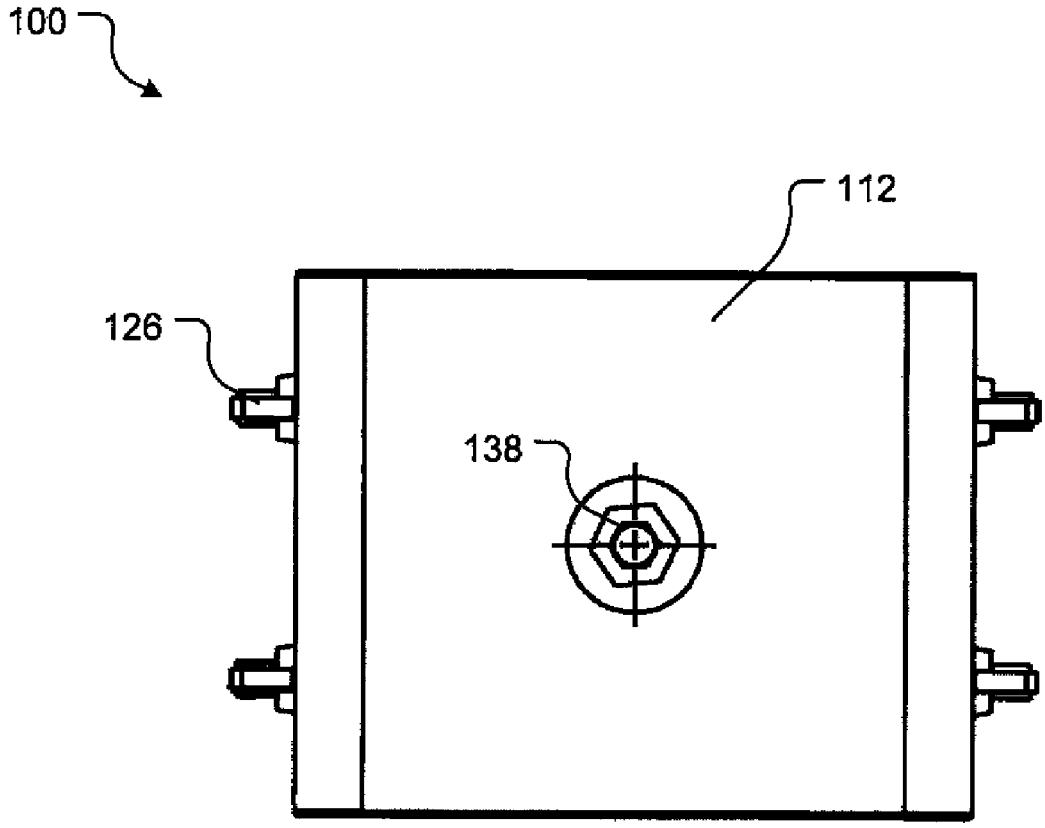
FIG. 1E is a top view of the magnetic fastener holder of FIG. 1A.

Referring to FIGS. 1A-1E, various views of a tool 100, in accordance with an exemplary embodiment of the present invention, are illustrated therein. Tool 100 will at times also be referred to herein as a magnetic fastener holder 100. As shown, tool 100 has a main body 110. The main body 110 of the exemplary, illustrated embodiment is of a substantially "U" or "C" shape. However, it will be readily appreciated by one of ordinary skill in the art that various other shapes of main body 110 may be used without departing from the spirit and scope of the present invention. For example, and not for limitation, the main body 110 may alternatively be of substantially cylindrical, pyramidal, or trapezoidal shapes.

The main body 110 includes an upper portion 112 and a lower portion 114. The lower portion is adapted to magnetically attach to a ferrous surface of a structure. To this end, the lower portion 114 may include a plurality of magnetic feet 120. While FIGS. 1A-1E specifically illustrate a tool 100 having four feet 120, it should be appreciated that other embodiments are not limited as such. Moreover, while the exemplary, illustrated embodiment includes a plurality of adjustable feet 120, a simpler, alternative embodiment may be implemented without magnetic feet 120 and recesses 118, wherein the bottom surfaces 116 of the lower portions 114 are magnetized to enable magnetic coupling with a ferrous surface.

As shown, an exemplary foot 120 may include a vertical member 124 and a horizontal member 123 pivotally coupled together at a pivot point 122. The vertical member 124 is disposed within a corresponding recess 118 of the lower portion 114 of the tool 100 and is slidably coupled with the lower portion 114 via fasteners 125 and 126 and through respective grooves 127 and 119. The horizontal member 123 of the foot 120 also includes a magnetic portion 121 for magnetically coupling with a ferrous surface.

As shown, the feet 120 of the exemplary, illustrated embodiment are fully adjustable, enabling the tool 100 to be attached to surfaces of varying contours. For example, each foot 120 may be independently adjusted to different lengths by adjusting the foot 120 to different locations within recesses 118. Moreover, the angles of the horizontal members 123 of the feet 120, relative to the vertical members 124, may be adjusted to varying angles by rotating the horizontal members 123 about the pivot points 122.

The upper portion 112 of the main body 110 has coupled thereto a fastener holder assembly 130. Assembly 130 includes a drive bit holder 134, which is adapted to receive a conventional drive bit 132, such as a conventional ¼" hex or square drive bit. The drive bit 132 may be any of a variety of different types of drive bits, including but not limited to a Phillips-head bit, a flat-head screwdriver bit, a hex bit, a torx bit, a square Robertsons bit, a nut setter, and a socket adapter. Thus, because of the interchangeability with the various types of conventional drive bits, the tool 100 is configurable for use with a variety of different sizes and shapes of fasteners.

The assembly 130 also includes a spring 136, or other functionally equivalent device, that is disposed between the upper portion 112 of the main body 110 and the drive hit holder 134. The spring 136 is adapted to urge the drive bit holder 134, the drive bit 132, and any first fastener in communication therewith in the direction of the surface of the structure to which the tool 100 is attached. Thus, not only-does the tool 100 initially apply a positive force to the first fastener, but the tool 100 also continues to apply a positive force to the first fastener as the first fastener is secured to a second fastener and thereby potentially drawn away from the upper portion 112 and towards the surface of the structure. An upper shaft 137 of the assembly 130 passes through an aperture in the upper portion 112 of the main body 110 and is secured via fastener 138. Thus, during use, the upper shaft 137 is allowed to slide longitudinally between a first position (defined by the bottom surface of fastener 138) and a second position (defined by the upper surface of drive bit holder 134 and the maximum compression of spring 136).

In one embodiment, the assembly 130 is coupled with the upper portion 112 of the main body 110 such that the assembly, and therefore the first fastener in communication therewith, are prevented from rotating when the first fastener is being fastened to the second fastener. It should be appreciated that this may be achieved in a number of ways. For example, the upper shaft 137 may have a non-circular cross-section, such as a triangle, a square, a hexagon, a star, or the like. In order to prevent assembly 130 from rotating, the aperture in the upper portion 112 through which the upper shaft 137 passes may be sized and shaped similar to the upper shaft 137, to enable upper shaft 137 to freely slide through the aperture while at the same time being prevented from rotating therein. For example, if upper shaft 137 has a ¼" hexagonal cross-section, a ¼" (or slightly larger) hexagonal aperture through the upper portion 112 would allow the upper shaft 137 to slide therethrough, but it would not allow the upper shaft 137 to rotate therein.

Thus, the present disclosure provides for a tool that serves as "third hand" in applications requiring two fasteners to be joined together through a structure that prevents a workman from accessing both fasteners at the same time. The tool accordingly may be used to hold one of the two fasteners in place while the workman attaches the other. Additionally, various embodiments advantageously provide a tool that is adjustable to enable attachment to different surfaces of varying contours. Various embodiments are also advantageously adaptable to be used in conjunction with various different types and sizes of fasteners. Thus, a workman is not required to have a different fastener holder tool for each different fastener. Rather, such embodiments may work in conjunction with convention drive bits, which may be used for altogether separate purposes and which the workman already likely owns.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A tool for assisting the attachment or removal of a first fastener and a second fastener to or from a structure, comprising:

a lower portion adapted to magnetically attach to a surface of said structure; and an upper portion configured to be spaced a distance from said surface of said structure when said lower portion is magnetically attached to said surface of said structure, said upper portion having a holder extending therefrom and adapted to hold said first fastener, wherein said holder is actively biased to urge said first fastener in a direction of said surface of said structure and continues actively urging said first fastener towards said surface after said lower portion has been magnetically attached to said surface.

2. The tool as recited in claim 1 wherein said lower portion and said upper portion together form a substantially U-shaped main body.

3. The tool as recited in claim 1 wherein said holder comprises a spring disposed between said upper portion and an opposing surface of said holder, so as to supply a bias force to said first fastener.

4. A tool for assisting the attachment or removal of a first fastener and a second fastener to or from a structure, comprising:

a main body having a holder extending therefrom; and a plurality of adjustable feet adjustably coupled to said main body and adapted to magnetically attach to a surface of said structure, wherein said holder is biased to urge said first fastener in a direction of said surface of said structure and continues urging said first fastener towards said surface after said adjustable feet have been magnetically attached to said surface.

5. The tool as recited in claim 4 wherein said main body is substantially U-shaped.

6. The tool as recited in claim 4 wherein said holder is adapted to prevent rotation of said first fastener when said second fastener is being fastened to said first fastener.

7. The tool as recited in claim 4 wherein said holder comprises a spring disposed between said upper portion and an opposing surface of said holder, so as to supply a bias force to said first fastener.

8. The tool as recited in claim 4 wherein said feet are independently adjustable to enable attachment to an uneven surface of said structure.

9. The tool as recited in claim 8 wherein said feet are adjustable to different distances from said main body to enable attachment to said uneven surface of said structure.

10. The tool as recited in claim 8 wherein said feet are pivotally adjustable to different angles to enable attachment to said uneven surface of said structure.

11. A tool system for assisting the attachment or removal of a first fastener and a second fastener to or from a structure, comprising:

a drive bit adapted to mate with said first fastener; and a magnetic fastener holder comprising:

a lower portion adapted to magnetically attach to a surface of said structure; and an upper portion configured to be spaced a distance from said surface of said structure when said lower portion is magnetically attached to said surface of said structure, said upper portion having a drive bit holder extending therefrom, wherein said drive bit holder is adapted to receive said drive bit, and wherein further said drive bit holder is biased, irrespective of an orientation of said tool system, to urge said drive bit and said first fastener in a direction of said surface of said structure and continues urging said drive bit towards said surface after said lower portion has been magnetically attached to said surface.

12. The tool system as recited in claim 11 wherein said drive bit comprises a ¼" drive bit.

13. The tool system as recited in claim 11 wherein said drive bit comprises a Phillips-head screwdriver bit.

14. The tool system as recited in claim 11 wherein said drive bit comprises a flat-head screwdriver bit.

15. The tool system as recited in claim 11 wherein said drive bit comprises a square Robertsons bit.

16. The tool system as recited in claim 11 wherein said drive bit comprises a socket adapter.

17. The tool system as recited in claim 11 wherein said drive bit comprises a nut setter.

18. The tool as recited in claim 11 wherein said holder is adapted to prevent rotation of said first fastener when said second fastener is being fastened to said first fastener.

19. The tool as recited in claim 11 wherein said comprises a spring disposed between said upper portion and an opposing surface of said holder, so as to supply a bias force to said first fastener.

20. A tool for assisting the attachment or removal of a first fastener and a second fastener to or from a structure, comprising:

a lower portion adapted to magnetically attach to a surface of said structure; and an upper portion configured to be spaced a distance from said surface of said structure when said lower portion is magnetically attached to said surface of said structure, said upper portion having a holder extending therefrom and adapted to hold said first fastener and prevent rotation of said first fastener when said second fastener is being fastened to said first fastener, wherein said holder is biased to actively urge said first fastener in a direction of said surface of said structure and continues actively urging said first fastener towards said surface after said lower portion has been magnetically attached to said surface.

* * * * *